US006626966B2

(12) United States Patent
Shimasaki et al.

(10) Patent No.: US 6,626,966 B2
(45) Date of Patent: Sep. 30, 2003

(54) COAL BRIQUETTE AND PRODUCTION THEREOF

(75) Inventors: Katsunori Shimasaki, Takasago (JP); Tetsuya Deguchi, Takasago (JP); Satoru Sugita, Takasago (JP); Eiichiro Makino, Tokyo (JP)

(73) Assignee: Kabushiki Kaisha Kobe Seiko Sho, Hyogo (JP)

( * ) Notice: Subject to any disclaimer, the term of this patent is extended or adjusted under 35 U.S.C. 154(b) by 0 days.

(21) Appl. No.: 10/216,212

(22) Filed: Aug. 12, 2002

(65) Prior Publication Data

US 2003/0046864 A1 Mar. 13, 2003

(30) Foreign Application Priority Data

Aug. 30, 2001 (JP) ..... 2001-261612

(51) Int. Cl.[7] ..... C10L 5/14

(52) U.S. Cl. ..... 44/550; 44/569; 44/572; 44/577; 44/593; 44/542; 44/544; 44/545

(58) Field of Search ..... 44/550, 569, 552, 44/577, 593, 542, 544, 545

(56) References Cited

U.S. PATENT DOCUMENTS

| | | | | | |
|---|---|---|---|---|---|
| 4,501,593 | A | * | 2/1985 | Paersch et al. | 44/564 |
| 4,738,685 | A | * | 4/1988 | Goleczka et al. | 44/557 |
| 4,981,494 | A | * | 1/1991 | Breuil et al. | 44/560 |
| 5,009,671 | A | * | 4/1991 | Franke et al. | 44/598 |
| 5,244,474 | A | * | 9/1993 | Lorcks et al. | 44/557 |
| 6,013,116 | A | * | 1/2000 | Major et al. | 44/551 |

* cited by examiner

*Primary Examiner*—Margaret Medley

(57) ABSTRACT

A method of producing coal briquette at a low energy cost by saving heating step or drying step for fine coal, which comprises adding and mixing from 1 to 10 mass parts of powdery starch to a coal having 15 mass % or more of water content and comprising 50 mass % or more of particles with grain size of 5 mm or less to form 100 mass parts of a mixture, and coating the surface of the briquette product with 0.1 to 5 mass parts of a heavy oil component simultaneously with or after pressure briquetting the mixture by a double roll briquetting machine in which concaves are formed on the roll surface, as well as coal briquette which is inexpensive and has high strength and high waterproof.

7 Claims, 2 Drawing Sheets

COAL BRIQUETTE AND PRODUCTION THEREOF

BACKGROUND OF THE INVENTION

1. Field of the Invention

The present invention relates to a technique of fine coal briquetting and, specifically, relates to a pressure briquetting of coal at a normal temperature, and the production thereof.

2. Description of Related Art

A great amount of fine coal are disadvantageously formed in the production process of coal in coal mines and subsequent transportation steps. Particularly, coal of low degree of coalification (brown coal and sub-bituminous coal), which is reserved and mined in great amount in Indonesia or other districts, yield 30 mass % or more of fine coal with a grain size of 2.35 mm or less in the production process and transportation step, to bring about a significant problem. Such fine coal is difficult to be handled with if used as it is and besides it causes fine dusts. This prevents the fine coal from being used in a generating power plant, so that the fine coal is discarded as wastes along with the production of coals. Accordingly, when such fine coal can be agglomerated into briquette products (coal briquette) having both the strength durable to handling during storage and transportation and waterproof against rainfall in the outdoor at a reduced cost, the coal productivity is improved. This leads to an effective use of natural resources and also to a great advantage in various points.

While various reports for the technique of briquetting coal have been presented but they concern coal briquette used in coke material, and have not yet applied to inexpensive common coal or coal of low degree of coalification from an economical view point.

For example, JP-A No.259382/1998 discloses a briquetting method of classifying coal arranged to comprise 85% or more of grains of less than 3 mm size, removing coal with a grain size of 6 mm over, heating the residues at a heating rate of $10^{3°}$ C./min or more for 300 to 420° C. and then briquetting the same. JP-A No. 3458/1997 discloses a briquetting method of drying coal to a water content of 0 to 2.7%, adding 3 to 5 mass % of tar and/or tar slag to classified and recovered fine coal of 0.3 mm or less, and then briquetting the same by way of a roll briquetting machine. However, both techniques require coal to be heated, suffering from high energy cost. Particularly, in case of processing coal of low degree of coalification having high water content, they also require dewatering and heating. This prevents those techniques from being practically used.

SUMMARY OF THE INVENTION

Under the foregoing situations, the present invention aims at providing a method of producing coal briquette free from the drawbacks of the prior art, specifically, a method of producing coal briquette at a reduced energy cost by saving heating step or drying step of coal which was necessary so far for fine coal briquetting, and provide coal briquette which is inexpensive, and has high strength and high waterproof.

In first aspect, the invention provides a coal briquette in which a heavy oil component is coated on the surface of a briquette product obtained by adding and mixing starch to fine coal and pressure briquetting them.

In second aspect, the fine coal contains 15 mass % or more of water content and comprising 50 mass % or more of grains of 5 mm or less.

In third aspect, the addition amount of the starch is from 1 to 10 mass % based on the mass of the briquette product.

In fourth aspect, starch is formed by dissolving starch with hot water into gel and then drying the same into a powdery form.

In fifth aspect, the coating amount of the heavy oil component is from 0.1 to 5 mass % based on the mass of the briquette product.

In sixth aspect, a method of producing coal briquette of the invention has the steps of: adding from 1 to 10 mass parts of powdery starch, to a coal having 15 mass % or more of water content and having 50 mass % or more of grains, with a grain size of 5 mm or less before followed by mixing them, so as to form 100 mass parts of a mixture; and coating the surface of the briquette product with 0.1 to 5 mass parts of a heavy oil component simultaneously with or after pressure briquetting the mixture.

In seventh aspect, the pressure briquetting is conducted by using a double roll briquetting machine in which concave portions are formed on the roll surface.

In the present specification, "briquette product" is defined as a product only as pressure briquetting but not yet applied with coating treatment, and also "coal briquette" is defined as "briquette product" further applied with coating treatment.

When starch is added and mixed to the fine coal, starch is uniformly dispersed into gaps between the coal particles. Then, the mixture is briquetted by pressure, and thereby a portion of the water content of the coal is leached to the surface of the coal particles. These water content and the starch are heated to a temperature of about 60° C. by the heat of friction upon pressure briquetting, converting into starch. Thereafter, they, through being gelled after cooling, firmly adhere the coal particles to each other. That is, the starch functions as a binder. In addition, the heavy oil component is coated on the surface of the briquette product as a coating agent to thereby form a coated coal briquette. This allows the heavy oil component, which is a hydrophobic material solid or liquid at normal temperature, to clog pores on the surface of the briquette product to inhibit water from intruding into the inside of the coal briquette, e.g. when the coal briquette is exposed to water of rainfall at the outdoor. This prevents gelled starch from being softened with an excess water content. And this also maintains adherence between coal particles to each other, keeping the strength of the coal briquette for a long period of time, even in the storage or transportation of the coal briquette in an external environment. That is, an obtained briquette product is excellent in waterproof.

The use of the fine coal with a water content of 15 mass % or more and, more preferably, 25 mass % or more allows a sufficient amount of water content to be leached out to the surface of coal particles upon pressure briquetting. This allows starch to be gelled sufficiently to thereby further increase the strength of adherance between coal particles to each other. Further, arranging the grain distribution such that 50% or more, more preferably, 60 mass % or more and, further preferably, 70 mass % or more, and the most preferably, 80 mass % or more of the fine coal a grain size of which is 5 mm or less, permits of the increase of the number of contacts between the particles to each other and relative to the starch as the binder, as well as of the increase of the strength of the coal briquette.

When the addition amount of starch is less than 1 mass %, the amount of the gelled starch is insufficient, causing to lower the strength of the coal briquette. On the other hand, considering that the effect of improving the strength of the coal briquette is small by addition in excess of 10 mass % and it is wasteful, addition amount is, preferably, 1 to 10 mass % and, more preferably, 3 to 5 mass %.

For the starch added to the fine coal, similar effect can also be obtained by using starch which was previously dissolved by hot water and formed into gel and then dried to a powdery state.

When the coating amount of the heavy oil component to the surface of the briquette product is less than 0.1 mass % based on the mass of the briquette product, the coating is not complete and water is liable to intrude from the outside to the inside of the briquette product to possibly lower the strength of the briquette product. On the other hand, considering that coating in excess of 5 mass % has no more effect and is wasteful, it is preferably from 0.1 to 5 mass % and, more preferably, from 0.5 to 3 mass %.

For conducting the pressure briquetting, for example, by a double roll briquetting machine having concaves at the roll surface, since a sufficient pressing force is applied as far as the inside of the briquette product, a sufficient amount of water content is leached out from the fine coal for the entire briquette product and, in addition, temperature elevation due to frictional force is made uniform to promote gelation of starch.

Other and further objects, features and advantages of the invention will appear more fully from the following description.

DETAILED DESCRIPTION OF THE PREFERRED EMBODIMENT

Figure 1:
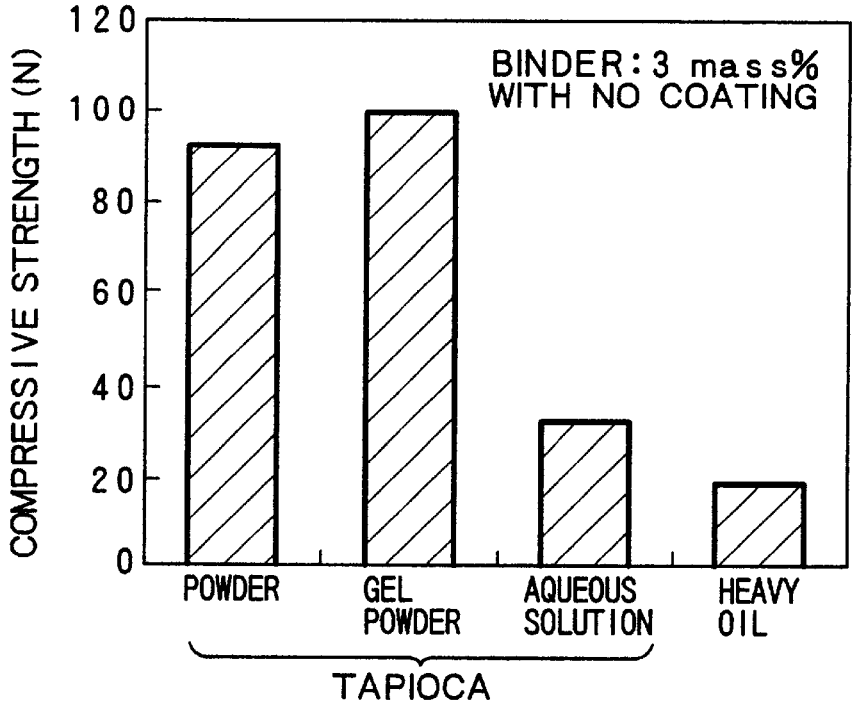
FIG. 1 is a graph showing a relation between the kind of binders and the compressive strength of briquettes.

There is no particular restriction on the water content in the fine coal that can be used in this invention. Those in which a sufficient amount of water content is leached out to the surface of the coal particles upon pressure briquetting are preferred. Those with the water content of 15 mass % or more, more preferably, 25 mass % or more are used preferably. Since the coal of such high water content usually has low coalification degree, the surface is hydrophilic and has good adhesion with the hydrophilic gelled powder thereby contributing to the improvement of the strength of the briquette product. In the case of using a fine coal with the water content of less than 15 mass %, a predetermined amount of water may be added to increase the water content corresponding to the content described above, or another powdery powder of higher water content may be mixed by a predetermined amount to make the average water content to that corresponding to the water content described above.

There is no particular restriction on the grain size of the fine coal that can be used in this invention and finer coal is preferred since the strength of the briquette product increases. Since the number of contacts between the coal particles to each other and relative to the starch as the binder increases the strength of the coal briquette increases further by arranging such that 50 mass % or more, more preferably, 60 mass % or more, further preferably, 70 mass % or more and, particularly preferably, 80 mass % or more of particles has grain size of 5 mm or less. In a case of using coal in which less than 50 mass % of the particles has a grain size of 5 mm or less, the coal may be pulverized into the grain size range described above or the coal may be mixed with another fine coal of finer grain size to adjust the grain size after mixing is within the range described above.

There is no particular restriction on the kind of the starch usable in this invention and those starches produced from raw material plants such as tapioca, potato and corn can be used properly. Starch can be obtained, for example, by pulverizing starting material plant together with cold water, and then by settling being stood still from the solution removed with solid matters, which may be dried and used as the starch in this invention. Further, use of starch formed by once dissolving starch with hot water to form gel and then drying (hereinafter referred to as gelled starch) is more preferred since this can further increase the strength of the briquette product as described above. The shape of starch is preferably powdery in view of uniform mixing with the fine coal.

The mixing method of the fine coal and the starch can include a dry mixing of mixing without using medium such as water or wet mixing of mixing starch in a state being suspended in water. A dry mixing is suitable which enhances the compressive strength of the briquette product more as will be described later in Example 1.

Then, for obtaining a predetermined strength of the briquette product, the above mentioned starch is mixed by 1 to 10 mass %, more preferably, 3 to 5 mass % with the fine coal based on the mass of the briquette product, and a mixture is prepared by using a known mixing machine such as a drum mixer or V-type mixer while properly adjusting the rotational speed, mixing time or the like of the mixing machine in order to obtain uniform mixture.

There is no particular restriction on the method of producing a briquette product by pressure briquetting the mixture, it is recommended for the use of the double roll briquetting machine in which concaves are disposed on the roll surface which can uniformly press the briquette product as far as the inside thereof as described above.

For the heavy oil component coated on the surface of the briquette product, hydrophobic material which is solid or liquid at normal temperature such as heavy oils, petroleum purification residue oils, liquefied coal oils and tars can properly be selected and used. Further, two or more kinds of the liquid hydrophobic materials may be mixed for use. There is no particular restriction on the method of coating the heavy oil component to the surface of the briquette product and any known methods can be used properly. One of those is a method of coating the heavy oil component to the surface of the briquette product simultaneously with the pressure briquetting of the mixture, such as a method of pressure briquetting the mixture while adding the heavy oil component to the roll surface, for example, of the double roll briquetting machine. Another is a method of coating the heavy oil component to the surface of the briquette product after pressure briquetting the mixture, such as the methods of dipping the briquette product in a container filled with the heavy oil component or of blowing the heavy oil component by way of spraying to the briquette product. In a case of using the heavy oil component of low fluidity at normal temperature, it may be used after heating to improve the fluidity for attaining more uniform coating.

The coal briquette according to this invention can be obtained by coating the heavy oil component to the surface of the briquette product preferably by 0.1 to 5 mass % and, particularly preferably, 0.5 to 3 mass % based on the mass of the briquette product.

EXAMPLE

For confirming the function and the effect of the invention, the following laboratory test was conducted. Table 1 shows the properties of coal A used in the experiment. The coal A is low rank coal with a water content of 25.2 mass % as shown in Table 1 and 90 mass % thereof comprises grains of 5 mm or less. Further, powdery tapioca (starch B) was used as the starch for the binder, while heavy oil C of LSWR (Low Sulfur Waxy Residue: specific weight: 0.908) manufactured in Indonesia was used as the heavy oil component for the coating agent.

TABLE 1

| | Water content | Proximate analysis (mass %-dry) | | Elemental analysis (mass %-dry ash free) | | | | | Bulk density (g/cm³) |
|---|---|---|---|---|---|---|---|---|---|
| | | Ash | Volatile matter | C | H | N | S | O | |
| Coal A | 25.2 | 8.13 | 48.01 | 75.37 | 5.55 | 1.18 | 0.66 | 17.24 | 0.67 |

Example 1

At first, the following experiment was conducted in order to study the effect of the kind of the binder on the compressive strength of the briquette product.

To coal A, (1) powdery tapioca as it is (starch B), (2) gel powder B' formed by gelling powdery tapioca with hot water and then drying and pulverizing the same, (3) 10 mass % aqueous solution B" formed by dissolving powdery tapioca in cold water as the binder, and (4) heavy oil C were added each in 3 mass % based on the mass of the briquette product respectively (in which (3) was added by 3 mass % in a dry powder amount), and mixed for about 3 minutes by a high speed stirring mixing type mixer (manufactured by Eirich Co.) and then prepared into pillow type briquettes (briquette product) each of 38 mm square×24 mm thickness by a double roll briquetting machine having a roll diameter of 520 mm and roll width of 120 mm under a pressure of 11.8 MPa. Then, the briquettes were instantly measured without applying coating for the briquetting strength by a compressive strength meter. FIG. 1 shows the result as a relation between the kind of the binder and the compressive strength of the briquettes. As shown in FIG. 1, a high compressive strength of about 90 N was obtained in a case of using powdery tapioca as it is (starch B), and in a case of using the gel powder B', the compressive strength was further increased to reach about 100 N. On the other hand, only low compressive strength was obtained as about 30 N in a case of using tapioca as an aqueous solution (starch B") and about 20 N in the case of using the heavy oil C. It is assumed that the compressive strength was low in a case of using the starch as the aqueous solution because the viscosity of the pasty starch formed by frictional heat upon pressure briquetting was low in view of excess water content and it did not secure the coal particles to each other sufficiently. Further, it is assumed that the compressive strength was low in a case of using the heavy oil because the surface of coal particles being hydrophilic, had less affinity with the hydrophobic heavy oil. As apparent from the foregoing results, the starch as the binder is used preferably in the powdery form and it may be used in a gel powder.

Example 2

Then, for studying the effect of the addition amount of starch on the compressive strength of the briquette product, the following experiment was conducted.

Figure 2:
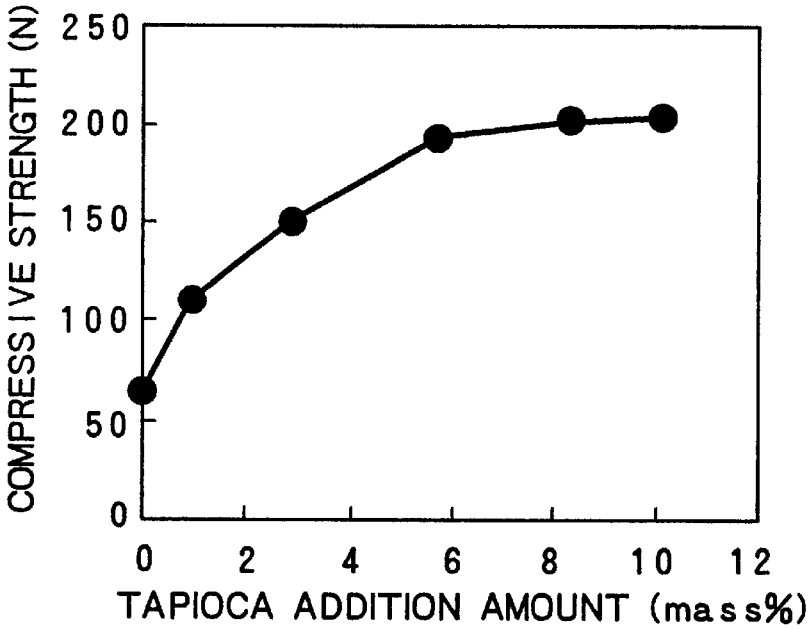
FIG. 2 is a graph showing a relation between the addition amount of starch and the compressive strength of briquette.

Powdery tapioca (starch B) was added to coal A while varying the quantity within a range of 0 to 10 mass % based on the mass of the briquette product and briquettes (briquette products) were manufactured in the same process as in Example 1. Then, the compressive strength was measured without applying coating after about one day for the briquette products. FIG. 2 shows the result as a relation between the addition amount of tapioca (starch) and the compressive strength of the briquette product. As shown in FIG. 2, the compressive strength of the briquette product at about 60 N for the non-addition of the binder (tapioca addition amount=0 mass %) was remarkably increased along with increase in the addition amount of tapioca (starch B) and the compressive strength exceeded 100 N at the addition amount of 1 mass %, the compressive strength reached about 150 N at the addition amount of 3 mass % and the compressive strength reached 200 N at the addition amount of 6 mass %. However, when the addition amount exceeded 6 mass %, a rate of increase of the compressive strength was reduced and at the addition amount of about 10 mass % or more, it was observed that the compressive strength no more increased. Between Example 1 and Example 2, the compressive strength is different in a case of adding the same kind of binder by the same amount (specifically, while the compressive strength is about 90 N for "powder" in FIG. 1, the compressive strength is about 150 N for "tapioca addition amount 3 mass %" in FIG. 2). This is due to the following reasons. That is, while the compressive strength was measured just after briquetting in Example 1, the compressive strength was measured about one day after the briquetting in Example 2. Accordingly, water content was gradually evaporated into atmospheric air and removed from the gelled starch along with lapse of time also at a room temperature, and the gelled starch was hardened to increase the compressive strength.

Example 3

Then, for studying the effect of the kind of the coating agent on the waterproof, the following experiment was conducted.

Figure 3:
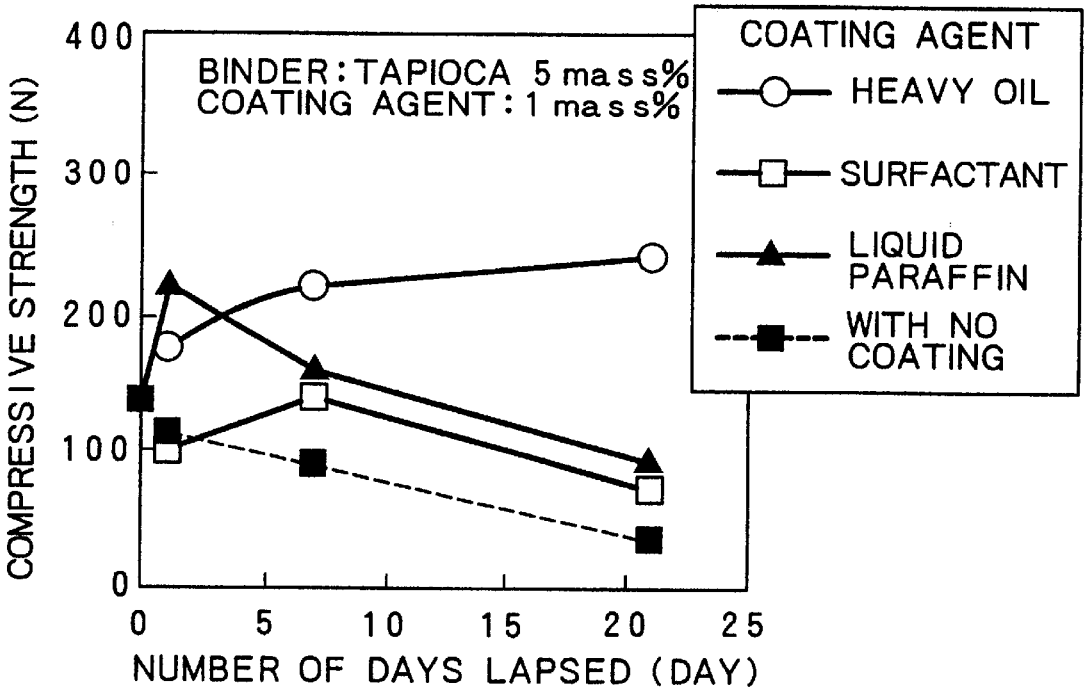
FIG. 3 is a graph showing a relation between the number of days lapsed and the compressive strength of briquettes in a waterproof test.

A powdery tapioca (starch B) was added as the binder by 5 mass % to coal A based on the mass of the briquette product and briquettes were manufactured by the same method as in Example 1. As the coating agent, heavy oil C, surfactant, and liquid paraffin were added each by 1 mass % to the briquettes based on the mass of the briquette product. Then, as a waterproof test, the briquettes coated with the coating agents and briquettes not coated with the coating agents (briquette products) were placed each by about 50 pieces on a net in a room, to which an operation of spraying water once per one day each time with 1000 ml to wet the surface of the briquettes was repeated. The net was used so that water accumulated by scattering did not result in a state of dipping briquettes in water. Then, the compressive strength of each briquettes was measured at 1, 7, 14 and 21th days from the coating of the coating agent. FIG. 3 shows a result as a relation between the number of days elapsed and the compressive strength of the briquettes. As shown in FIG. 3, the compressive strength of the briquettes with no coating lowered abruptly with lapse of the number of days. The reason for the abrupt lowering of the compressive strength is that sprayed water was soaked into the briquettes to soften the gelled starch with an excess water content and, in addition, the coal particles of low coalification degree themselves were swollen by absorption of water. On the contrary, the compressive strength of the briquettes coated with the heavy oil increased with lapse of the number of days. The reason for the increase of the compressive strength dues to the evaporation and removal of the water content from the gelled starch by the same reason as explained in the last paragraph for Example 2. On the other hand, in the briquettes coated with the liquid paraffin, although the compressive strength increased at the initial stage (first day) it was lowered subsequently with lapse of number of days. The reason why the compressive strength increased in the initial stage (first day) is identical with that in the case of coating the heavy oil and the reason for the subsequent reduction of the compressive strength is considered to be attributable to that liquid paraffin evaporated gradually also at a room temperature because of low boiling point to make the coating for the briquette surface not complete and scattered water intruded in the briquettes. Since the heavy oil is stable having a relatively high boiling point, such a problem was not caused. Further, the compressive strength of the briquettes coated with the surfactant was lowered substantially along with lapse of the number of days. It is considered that since the surfactant being hydrophilic has less effect for preventing scattered water from intruding into the briquettes.

Example 4

Then, for studying the effect of the coating amount of the heavy oil component on the compressive strength of the coal briquette, the following experiment was conducted.

Figure 4:
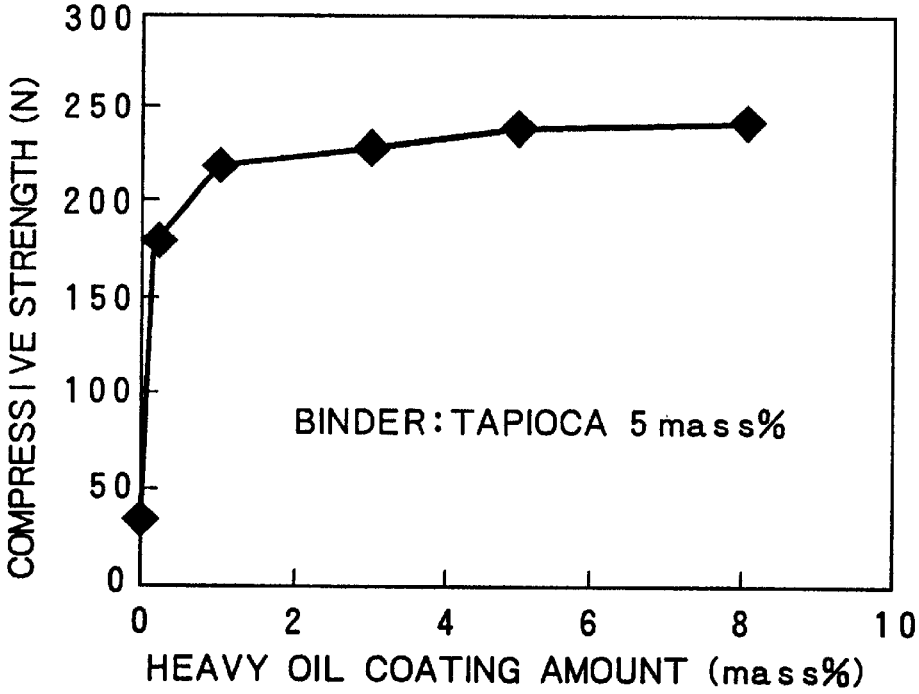
FIG. 4 is a graph showing a relation between the coating amount of heavy oil and the compressive strength of briquette in a waterproof test.

Powdery tapioca (starch B) was added as a binder by 5 mass % to the coal A based on the mass of the briquette product were manufactured in the same process as in Example 1. Further, the heavy oil C was coated to the briquettes while varying the mass within a range from 0 to 8 mass % based on the mass of the briquette product. Then, the same waterproof test as in Example 3 was conducted for the briquettes after coating the heavy oil. FIG. 4 shows a relation between the coating amount of the heavy oil and the compressive strength of the briquettes after 21th day. As shown in FIG. 4, the compressive strength of the briquettes 21th day after the coating was abruptly increased to about 180 N by the coating amount of the heavy oil of 0.1 mass %, from the compressive amount at about 30 N in a case of not coating the heavy oil (heavy oil coating amount=0 mass %), and the compressive strength was gradually increased along with the increase in the coating amount as at about 220 N for 1 mass % and 230 N for 5 mass %. However, further increase of the coating amount did not substantially increase the compressive strength.

As has been described above, the method of producing the coal briquette according to this invention requires less energy cost since heating for coal is not necessary and can manufacture the coal briquette inexpensively. Further, the coal briquette according to this invention has high compressive strength and is excellent in waterproof after briquetting. Accordingly, the compressive strength does not lower even under long time storage at the outdoor or during long distance transportation with no canopy, which can prevent cracking or powderization by handling. As a result, the coal production loss can be reduced by the effective utilization of the fine coal and can effectively utilize natural resources.

The foregoing invention has been described in terms of preferred embodiments. However, those skilled, in the art will recognize that many variations of such embodiments exist. Such variations are intended to be within the scope of the present invention and the appended claims.

What is claimed is:

1. A coal briquette wherein a heavy oil component is coated on the surface of a briquette product obtained by adding starch to fine coal, mixing them, and pressure briquetting them.

2. A coal briquette according to claim 1, wherein the fine coal contains 15 mass % or more of water content and comprising 50 mass % or more of grains of 5 mm or less.

3. A coal briquette according to claim 1, wherein the addition amount of the starch is from 1 to 10 mass % based on the mass of the briquette product.

4. A coal briquette according to claim 1, wherein starch is formed through the steps of dissolving with hot water so as to bring it into gel, and drying the same into a powdery form.

5. A coal briquette according to claim 1, wherein the coating amount of the heavy oil component is from 0.1 to 5 mass % based on the mass of the briquette product.

6. A method of producing coal briquette, which comprises the steps of adding from 1 to 10 mass parts of powdery starch to a coal having 15 mass % or more of water content and comprising 50 mass % or more of grains with a grain size of 5 mm or less, mixing them to form 100 mass parts of a mixture, and coating the surface of the briquette product with 0.1 to 5 mass parts of a heavy oil component simultaneously with or after pressure briquetting the mixture.

7. A method of producing a coal briquette according to claim 6, wherein the pressure briquetting is conducted by using a double roll briquetting machine in which concave portions are formed on the roll surface.

* * * * *